US009781499B2

(12) United States Patent
Kar

(10) Patent No.: US 9,781,499 B2
(45) Date of Patent: Oct. 3, 2017

(54) ELECTRONIC DEVICE WITH WIND RESISTANT AUDIO

(71) Applicant: Intel Corporation, Santa Clara, CA (US)

(72) Inventor: Swarnendu Kar, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 49 days.

(21) Appl. No.: 14/672,045

(22) Filed: Mar. 27, 2015

(65) Prior Publication Data

US 2016/0286295 A1 Sep. 29, 2016

(51) Int. Cl.

| | |
|---|---|
| ***H04R 9/08*** | (2006.01) |
| ***H04R 1/08*** | (2006.01) |
| *H04R 1/02* | (2006.01) |
| *H04R 1/10* | (2006.01) |

(52) U.S. Cl.

CPC ..... *H04R 1/086* (2013.01); *H04R 1/028* (2013.01); *H04R 1/1008* (2013.01); *H04R 2410/07* (2013.01); *H04R 2460/13* (2013.01)

(58) Field of Classification Search

CPC ..... G02C 11/10; G02C 11/06
USPC ..... 381/359, 321, 313, 361
See application file for complete search history.

(56) References Cited

U.S. PATENT DOCUMENTS

| | | | | |
|---|---|---|---|---|
| 3,265,153 | A * | 8/1966 | Burroughs | H04R 1/08 181/158 |
| 2002/0158816 | A1* | 10/2002 | Snider | G09G 3/001 345/8 |
| 2004/0040072 | A1* | 3/2004 | Mizuno | A61F 11/14 2/423 |
| 2007/0017292 | A1* | 1/2007 | Sper | G01H 3/10 73/646 |
| 2012/0105740 | A1* | 5/2012 | Jannard | G02C 9/04 348/794 |
| 2014/0236594 | A1* | 8/2014 | Clarke | G02B 27/017 704/233 |
| 2014/0270244 | A1* | 9/2014 | Fan | G02C 11/10 381/91 |

* cited by examiner

*Primary Examiner* — Md S Elahee
*Assistant Examiner* — Julie X Dang
(74) *Attorney, Agent, or Firm* — Patent Capital Group

(57) ABSTRACT

Particular embodiments described herein provide for an electronic device that includes a plurality of audio acquisition areas. Each of the plurality of audio acquisition areas can include a microphone element to detect audio data, an audio opening that allows the audio data to travel to the microphone element, and a windscreen that covers at least the audio opening. An audio module can be configured to receive the audio data from each of the plurality of audio acquisition areas and enhance the audio data.

17 Claims, 6 Drawing Sheets

ELECTRONIC DEVICE WITH WIND RESISTANT AUDIO

TECHNICAL FIELD

This disclosure relates in general to the field of electronic devices, and more particularly, to an electronic device with wind resistant audio.

BACKGROUND

End users have more electronic device choices than ever before. A number of prominent technological trends are currently afoot (e.g., more computing devices, more detachable displays, more peripherals, etc.), and these trends are changing the electronic device landscape. One of the technological trends is the use of wearable electronic devices. In many instances, the wearable electronic device includes a microphone to allow for speech communication. However, wind noise can often interfere with the speech communication. Hence, there is a challenge in providing a wearable electronic device that will allow for speech communication, especially in the presence of wind noise.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

The FIGURES of the drawings are not necessarily drawn to scale, as their dimensions can be varied considerably without departing from the scope of the present disclosure.

DETAILED DESCRIPTION OF EXAMPLE EMBODIMENTS

Example Embodiments

Figure 1:
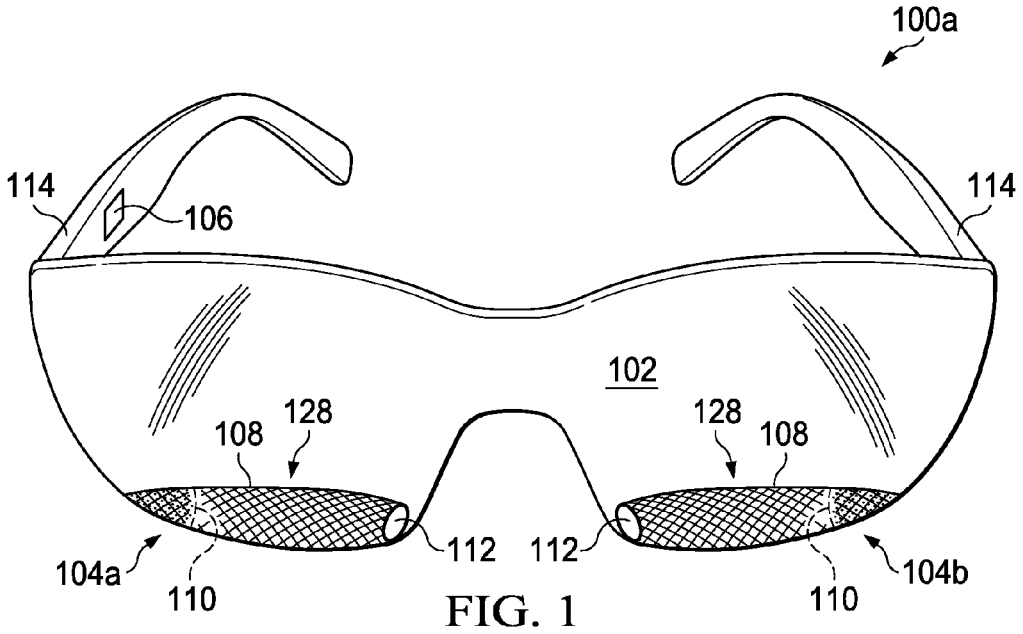
FIG. 1 is a simplified diagram illustrating an embodiment of a communication system in accordance with an embodiment of the present disclosure.

FIG. 1 is a simplified block diagram of an embodiment of an electronic device 100*a* that includes wind resistant audio capability in accordance with an embodiment of the present disclosure. Electronic device 100*a* can include lens 102, directional audio acquisition areas 104*a* and 104*b*, an audio module 106, and a frame 114.

Directional audio acquisition areas 104*a* and 104*b* can each include a windscreen 108, a microphone element 110, an audio opening 112, and an audio guide 128. Audio opening 112 can channel sound or audio data through audio guide 128 to microphone element 110. Audio opening 112 can help to focus the direction of microphone element 110 to create a directional microphone. Audio guide 128 can include mechanical slots or any other structure elements that can passively attenuate audio from non-axial directions (e.g., as in professional shotgun microphone).

Audio module 106 may be located in frame 114 of electronic device 100*a*. As illustrated in FIG. 1, directional audio acquisition areas 104*a* and 104*b* are located along a bottom portion of lens 102. Audio module 106 is located in an eyepiece portion of frame 114. Electronic device 100*a* may be a wearable electronic device with audio capabilities and in specific examples may be glasses, sunglasses, headphones, or some other wearable with audio capabilities that is worn on or near a face of a user.

In example embodiments, electronic device 100*a* can be configured to reduce the effect wind noise has on audio communications. For example, microphone element 110, audio opening 112, and audio guide 128 can be configured a directional microphone and may be covered by windscreen 108. An audio module 106 can process the captured audio data (e.g., audio data captured by directional audio acquisition area 104*a* and 104*b*) and enhance the audio quality.

Audio module 106 may be configured to determine what audio data is the cleanest or least distorted audio data that was captured by directional audio acquisition area 104*a* and 104*b*. Due to the linear nature of wind and the microphones being at different orientations, at least one of the multiple microphones should experience less wind noise than the others. For example, if wind is blowing left to right of FIG. 1, audio opening 112 of directional audio acquisition area 104*b* would be facing directly into the wind and therefore microphone element 110 of directional audio acquisition area 104*b* would capture a relatively large amount of wind noise. However, audio opening 112 of directional audio acquisition area 104*a* would not be facing directly into the wind and therefore microphone element 110 of directional audio acquisition area 104*a* would only capture a small amount of wind noise. Audio module 106 could be configured to analyze the audio data from directional audio acquisition area 104*a* and 104*b* and determine that the audio from directional audio acquisition area 104*a* has a better quality.

In another example, audio module 106 may combine the audio captured by directional audio acquisition area 104*a* and 104*b*. A weighting factor may be used where a larger percentage of the audio captured by one directional audio acquisition area is used over the other one. For example, if wind is blowing left to right of FIG. 1, audio opening 112 of directional audio acquisition area 104*b* would be facing directly into the wind and therefore microphone element 110 of directional audio acquisition area 104*b* would capture a relatively large amount of wind noise. However, audio opening 112 of directional audio acquisition area 104*a* would not be facing directly into the wind and therefore microphone element 110 of directional audio acquisition area 104*a* would only capture a small amount of wind noise. When the audio captured by directional audio acquisition area 104*a* and 104*b* is combined, a weighting factor may be used where a larger percentage of the audio captured by directional audio acquisition area 104*a* is used to create the combined audio signal.

For purposes of illustrating certain example techniques of electronic device 100*a*, it is important to understand the communications that may be traversing the network environment. The following foundational information may be viewed as a basis from which the present disclosure may be properly explained.

Many of today's electronic devices, especially wearables, include audio communication or some speech communication capability. For example, some headphones and glassware have a speech communication capability. In activity and sports eyewear with speech communication capability, for example smart glasses, audio quality can be significantly crippled due to a strong force of wind that hits the device. More specifically, if a user is riding a bicycle or running, the constant wind in the user's face can interfere with the audio quality detected by the electronic device. In most wearables, omnidirectional microphones are used, which capture the pressure vibrations due to the wind. Consequently, the audio signal is significantly distorted, leading to bad user experience. The effect due to wind is severe because it involves both a linear addition of noise and a non-linear clipping of raw samples due to saturation.

Some devices use a bone conduction microphone mounted on a nose bridge because they are relatively less perturbed by wind as compared to ordinary air microphones since the vibrations captured are mostly due to the skull vibrations which are less influenced by wind. However the bone conduction mechanism involves audio being transmitted through the skull cavity and since the skull cavity also absorbs sound of certain frequencies, the audio is distorted by the time it is captured by the microphone. This can result in a severe loss of speech quality due to the inherent mechanism of speech acquisition and results in a different kind of degradation of sound quality which is not desirable. Most users try to minimize the usage of speech capabilities, keeping conversations short. However, this results in a suboptimal usage of the device's full capabilities. What is needed is an electronic device with wind resistant audio.

A communication system, as outlined in FIG. 1 can resolve these issues (and others). Electronic device 100*a* may be configured to reduce or minimize wind interference in audio communications. The interference due to wind is minimized with the help of three key principles. In one example, a windscreen material may be used to cover the microphones used for audio communications. The windscreen material may be a foam like or fur like material that can diffuse the pressure fluctuations created by wind by breaking up big lumps of the wind into smaller chunks or bits before the wind reaches the audio opening. Windscreen material may be any material that includes small holes with twisted pockets of air or any other material that is relatively acoustically transparent and can break gusts of air into small and diffused chunks or bits.

In another example, a directional microphone may be used instead of an omnidirectional microphone. The directional microphone can help to capture an audio signal coming only from the direction of a user's mouth. Sound coming from a different direction than the mouth, such are wind noise, road noise, vehicle noise, etc., can be attenuated due to the directional nature of the microphone. This can help capture only a fraction of wind noise compared to an omnidirectional microphone. The directional microphones themselves may be single element microphones such as a shotgun or lavalier type microphone. Directional microphones can include multiple elements themselves and electronically steered to a particular direction of sound using techniques like delay-and-sum beamforming.

In another example, a multiplicity of microphones may be used to increase the space diversity of capturing the audio communications. Gusts of wind can be directional and change dynamically over time. The use of multiple microphones can increase the chances that one microphone among a plurality of microphones would remain relatively unperturbed by the wind. The microphone with the cleanest unit can be selected on a dynamic basis.

Multiple of these "windscreen plus directional microphone" units can be placed in different locations in the glass. For example, as illustrated in FIG. 1, directional audio acquisition areas 104*a* and 104*b* are shown as conforming to the bottom rim of the glass frame or to the side rims. Such diversity of locations result in even better performance, since the probability that both/all microphones are severely degraded due to wind, decreases. The wind flow is generally turbulent and changes directions over time so the best or cleanest microphone at any given time is the one that is oriented the farthest away from the instantaneous wind direction. A "best of all" approach, means selecting the microphone input least affected by wind. The input from the best or cleanest microphone may be determined by audio module 106 at regular intervals (e.g., about every 100 milliseconds) and create a composite output. Alternatively, algorithms may be used to fuse the audio data from directional audio acquisition areas 104*a* and 104*b* and create a single audio stream.

In regards to the internal structure associated with electronic device 100*a*, audio module 106 can include memory elements for storing information to be used in the operations outlined herein. Audio module 106 may keep information in any suitable memory element (e.g., random access memory (RAM), read-only memory (ROM), erasable programmable ROM (EPROM), electrically erasable programmable ROM (EEPROM), application specific integrated circuit (ASIC), etc.), software, hardware, firmware, or in any other suitable component, device, element, or object where appropriate and based on particular needs. Any of the memory items discussed herein should be construed as being encompassed within the broad term 'memory element.' Moreover, the information being used, tracked, sent, or received in electronic device 100*a* could be provided in any database, register, queue, table, cache, control list, or other storage structure, all of which can be referenced at any suitable timeframe. Any such storage options may also be included within the broad term 'memory element' as used herein.

In certain example implementations, the functions outlined herein may be implemented by logic encoded in one or more tangible media (e.g., embedded logic provided in an ASIC, digital signal processor (DSP) instructions, software (potentially inclusive of object code and source code) to be executed by a processor, or other similar machine, etc.), which may be inclusive of non-transitory computer-readable media. In some of these instances, memory elements can store data used for the operations described herein. This includes the memory elements being able to store software, logic, code, or processor instructions that are executed to carry out the activities described herein.

Additionally, audio module 106 may include a processor that can execute software or an algorithm to perform activities as discussed herein. A processor can execute any type of instructions associated with the data to achieve the operations detailed herein. In one example, the processors could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array (FPGA), an EPROM, an EEPROM) or an ASIC that includes digital logic, software, code, electronic instructions, or any suitable combination thereof. Any of the potential processing elements, modules, and machines described herein should be construed as being encompassed within the broad term 'processor.'

Figure 2:
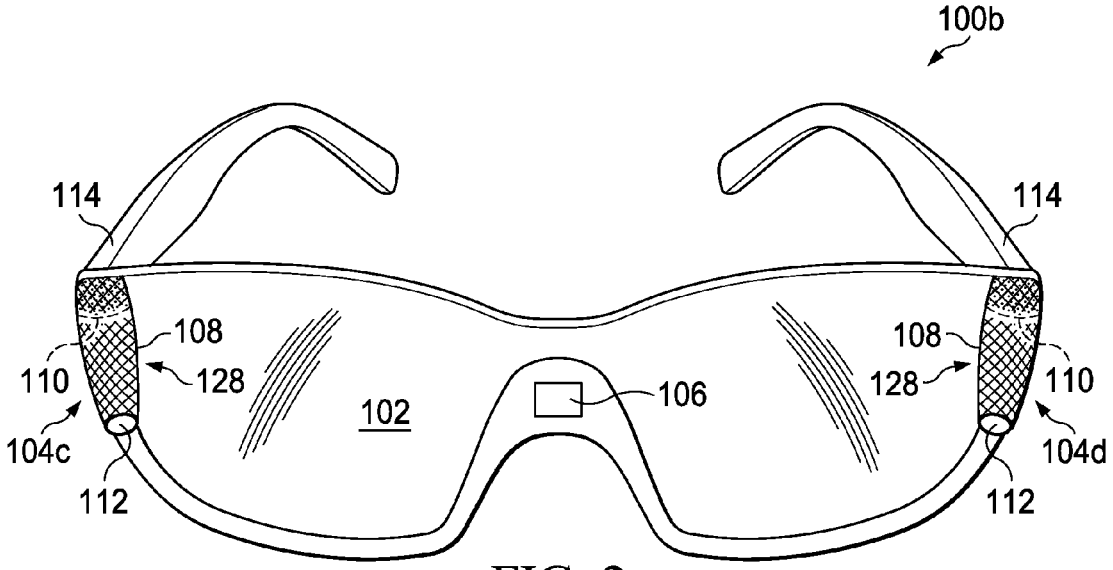
FIG. 2 is a simplified diagram illustrating an embodiment of a communication system in accordance with an embodiment of the present disclosure.

Turning to FIG. 2, FIG. 2 is a simplified block diagram of an embodiment of electronic device 100*b* that includes an electronic device with wind resistant audio capability in accordance with an embodiment of the present disclosure. Electronic device 100*b* can include lens 102, directional audio acquisition areas 104*c* and 104*d*, audio module 106, and frame 114. Direction audio acquisition areas 104*c* and 104*d* can each include windscreen 108, microphone element 110, audio opening 112, and audio guide 128. As illustrated in FIG. 2, directional audio acquisition areas 104*c* and 104*e* are located along a side portion of lens 102. Audio module 106 is located near a nose piece portion of frame 114.

Figure 3:
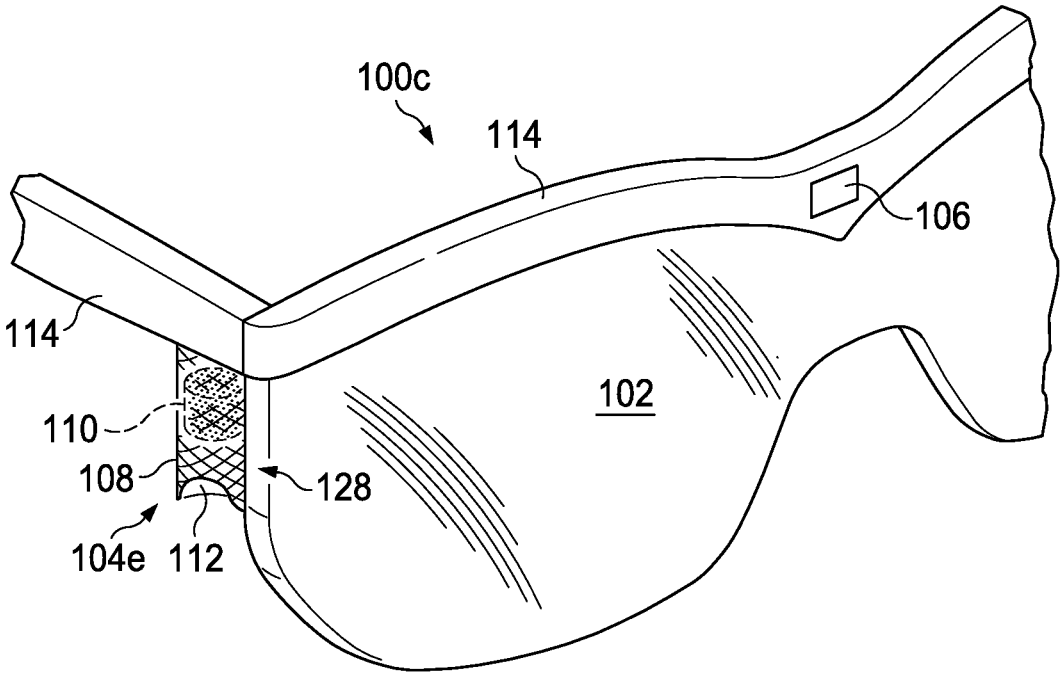
FIG. 3 is a simplified diagram illustrating an embodiment of a communication system in accordance with an embodiment of the present disclosure.

Turning to FIG. 3, FIG. 3 is a simplified block diagram of an embodiment of electronic device 100*c* that includes an electronic device with wind resistant audio capability in accordance with an embodiment of the present disclosure. Electronic device 100*c* can include lens 102, directional audio acquisition area 104*d*, an audio module 106, and frame 114. Directional audio acquisition area 104*d* can include windscreen 108, microphone element 110, audio opening 112, and audio guide 128. As illustrated in FIG. 3, directional audio acquisition area 104*d* is located along a back edge portion of lens 102. Audio module 106 is located in a top portion of frame 114.

As illustrated in FIGS. 1-3, audio module 106 can be located almost anywhere in frame 114. In addition, directional audio acquisition area (e.g., directional audio acquisition areas 104*a*-104*e*) can be located almost anywhere along an edge of lens 102. It should be noted that audio module 106 can be located anywhere that would allow audio module 106 to receive audio data from one or more directional audio acquisition areas 104*a*-104*e* and achieve, or to foster, operations as outlined herein. Also, directional audio acquisition areas 104*a*-104*e* may be located anywhere that would allow directional audio acquisition areas 104*a*-104*e* to acquire audio data and achieve, or to foster, operations as outlined herein.

Figure 4:
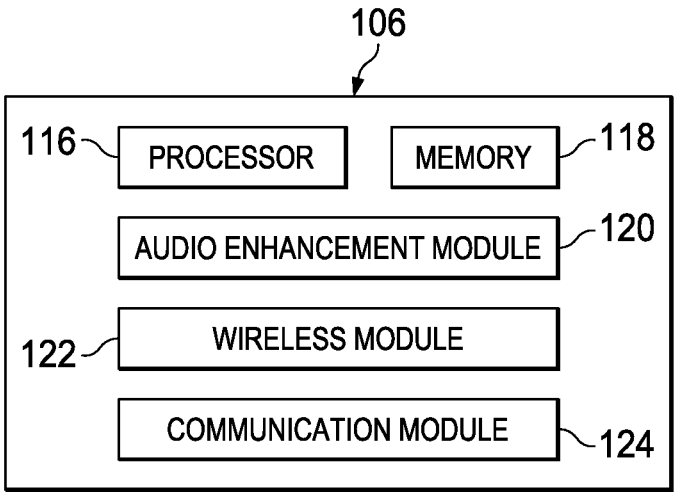
FIG. 4 is a simplified block diagram illustrating a portion of an embodiment of a communication system in accordance with an embodiment of the present disclosure.

Turning to FIG. 4, FIG. 4 is a simplified block diagram of an embodiment of audio module 106. Audio module 106 can include a processor 116, memory 118, an audio enhancement module 120, a wireless module 122, and a communication module 124. Audio enhancement module 120 can be configured to received audio data (e.g., from directional audio acquisition areas 104*a*-104*e*) and enhance the audio data. For example, audio enhancement module 120 may be configured to determine which directional audio acquisition area is providing the best or most preferred audio data and use that audio data for audio communications. Also, audio enhancement module 120 may fuse or combine the inputs from each directional audio acquisition area into a single composite output.

Wireless module 36 can be configured to wirelessly communicate (e.g., Bluetooth®, infrared data, wireless uniform serial bus (USB), etc.) with a network and/or a second electronic device. Communication module 124 can be configured to facilitate audio communications with other devices and interpret audio commands by a user or enable voice recognition capabilities and features.

In an example implementation, electronic devices 100*a*, 102*b*, and 102*c* may include software modules (e.g., audio module 106, audio enhancement module 120, wireless module 122, and communication module 124) to achieve, or to foster, operations as outlined herein. These modules may be suitably combined in any appropriate manner, which may be based on particular configuration and/or provisioning needs. In an embodiment, such operations may be carried out by hardware, implemented externally to these elements, or included in some other network device to achieve the intended functionality. Furthermore, the modules can be implemented as software, hardware, firmware, or any suitable combination thereof. These elements may also include software (or reciprocating software) that can coordinate with other network elements in order to achieve the operations, as outlined herein.

Figure 5:
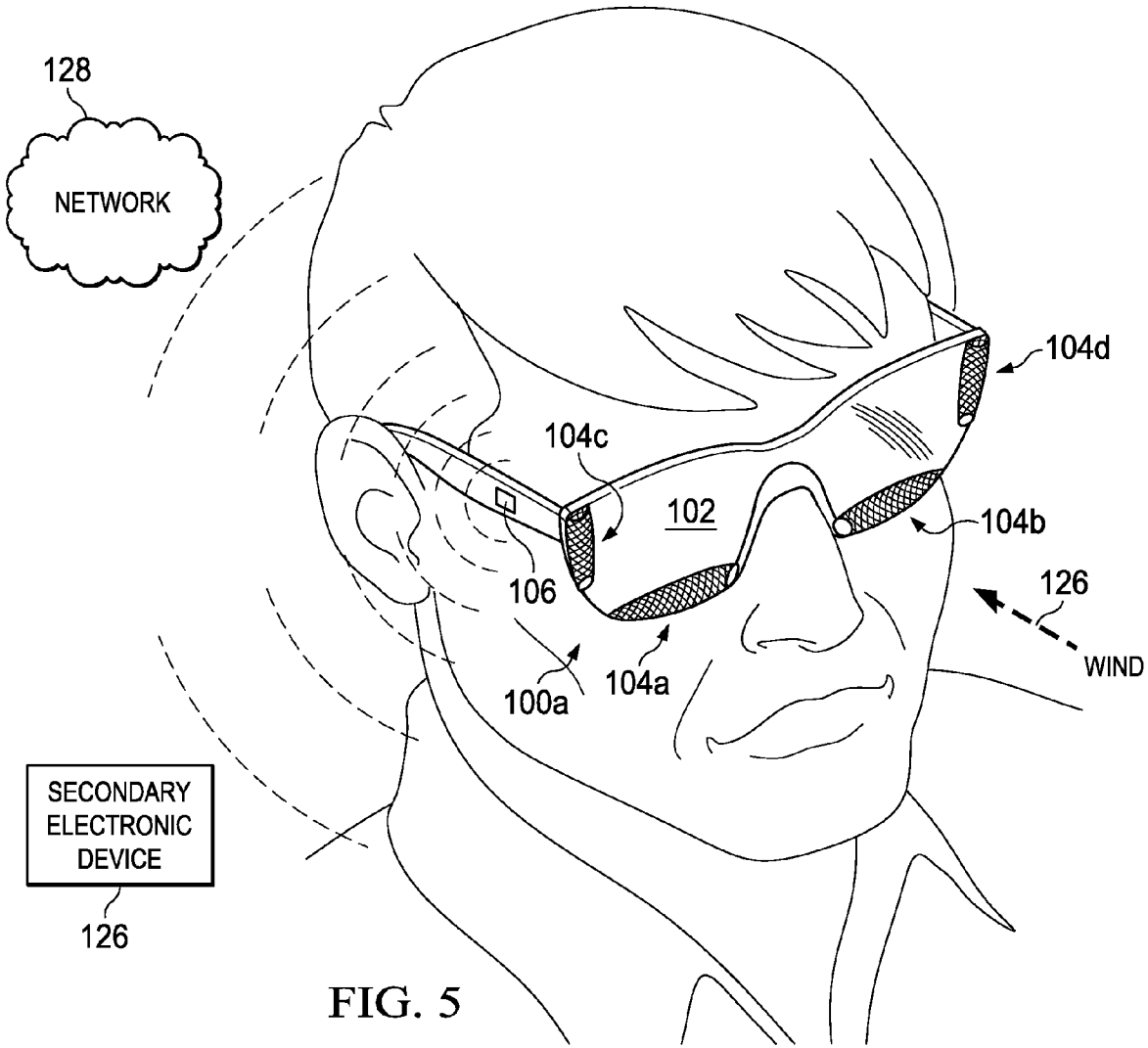
FIG. 5 is a simplified diagram illustrating an embodiment of a communication system in accordance with an embodiment of the present disclosure.

Turning to FIG. 5, FIG. 5 is a simplified schematic diagram illustrating an embodiment of electronic device 100*a*, in accordance with one embodiment of the present disclosure. Electronic device can be in communication with secondary electronic device 126 and network 128. As illustrated in FIG. 5, wind 126 may be blowing against electronic device 100*a*. One or more of directional audio acquisition area 104*a*-104*d* may be affected by wind 126 but it is unlikely that all directional audio acquisition areas 104*a*-104*d* would be affected by wind 126 equally. At least one of directional audio acquisition areas 104*a*-104*d* should be able to provide acceptable audio data.

Wireless module 36 (illustrated in FIG. 4) can be configured to wirelessly communicate (e.g., Bluetooth®, infrared data, wireless uniform serial bus (USB), etc.) with a second electronic device 126 and a network 128. Second electronic device 126 may be a desktop computer, laptop computer, Internet of things (IoT) device, mobile device, personal digital assistant, smartphone, tablet, portable gaming device, remote sensor, Bluetooth radio, cell phone, etc. The communication between electronic device 100*a* and second electronic device 126 may include a personal area network (PAN), a body area network, (BAN) or some other type of network.

Network 128 offers a communicative interface between nodes, and may be configured as any local area network (LAN), virtual local area network (VLAN), wide area network (WAN), wireless local area network (WLAN), metropolitan area network (MAN), Intranet, Extranet, virtual private network (VPN), and any other appropriate architecture or system that facilitates communications in a network environment, or any suitable combination thereof, including wired and/or wireless communication.

Elements of FIG. 5 may be coupled to one another through one or more interfaces employing any suitable connections (wired or wireless), which provide viable pathways for network (e.g., network 128) communications. Additionally, any one or more of these elements of FIG. 5 may be combined or removed from the architecture based on particular configuration needs. Electronic device 100*a* may include a configuration capable of transmission control protocol/Internet protocol (TCP/IP) communications for the transmission or reception of packets in a network. Electronic device 100*a* may also operate in conjunction with a user datagram protocol/IP (UDP/IP) or any other suitable protocol where appropriate and based on particular needs.

Turning to the infrastructure of FIG. 5, electronic device 100*a* in accordance with an example embodiment is shown. Generally, electronic device 100*a* can be configured to operate in any type or topology of networks. Network 128 represents a series of points or nodes of interconnected communication paths for receiving and transmitting packets of information that propagate through network 128. Network 128 offers a communicative interface between nodes, and may be configured as any local area network (LAN), virtual local area network (VLAN), wide area network (WAN), wireless local area network (WLAN), metropolitan area network (MAN), Intranet, Extranet, virtual private network (VPN), and any other appropriate architecture or system that facilitates communications in a network environment, or any suitable combination thereof, including wired and/or wireless communication.

Electronic device 100*a* can send and receive, network traffic, which is inclusive of packets, frames, signals, data, etc., according to any suitable communication messaging protocols. Suitable communication messaging protocols can include a multi-layered scheme such as Open Systems Interconnection (OSI) model, or any derivations or variants thereof (e.g., Transmission Control Protocol/Internet Protocol (TCP/IP), user datagram protocol/IP (UDP/IP)). Additionally, radio signal communications over a cellular network may also be provided in electronic device 100*a*. Suitable interfaces and infrastructure may be provided to enable communication with the cellular network.

The term "packet" as used herein, refers to a unit of data that can be routed between a source node and a destination node on a packet switched network. A packet includes a source network address and a destination network address. These network addresses can be Internet Protocol (IP) addresses in a TCP/IP messaging protocol. The term "data" as used herein, refers to any type of binary, numeric, voice, video, textual, or script data, or any type of source or object code, or any other suitable information in any appropriate format that may be communicated from one point to another in electronic devices and/or networks. Additionally, messages, requests, responses, and queries are forms of network traffic, and therefore, may comprise packets, frames, signals, data, etc.

In an example implementation, network 128 is meant to encompass network appliances, servers, routers, switches, gateways, bridges, load balancers, processors, modules, or any other suitable device, component, element, or object operable to exchange information in a network environment. Network elements may include any suitable hardware, software, components, modules, or objects that facilitate the operations thereof, as well as suitable interfaces for receiving, transmitting, and/or otherwise communicating data or information in a network environment. This may be inclusive of appropriate algorithms and communication protocols that allow for the effective exchange of data or information.

Figure 6:
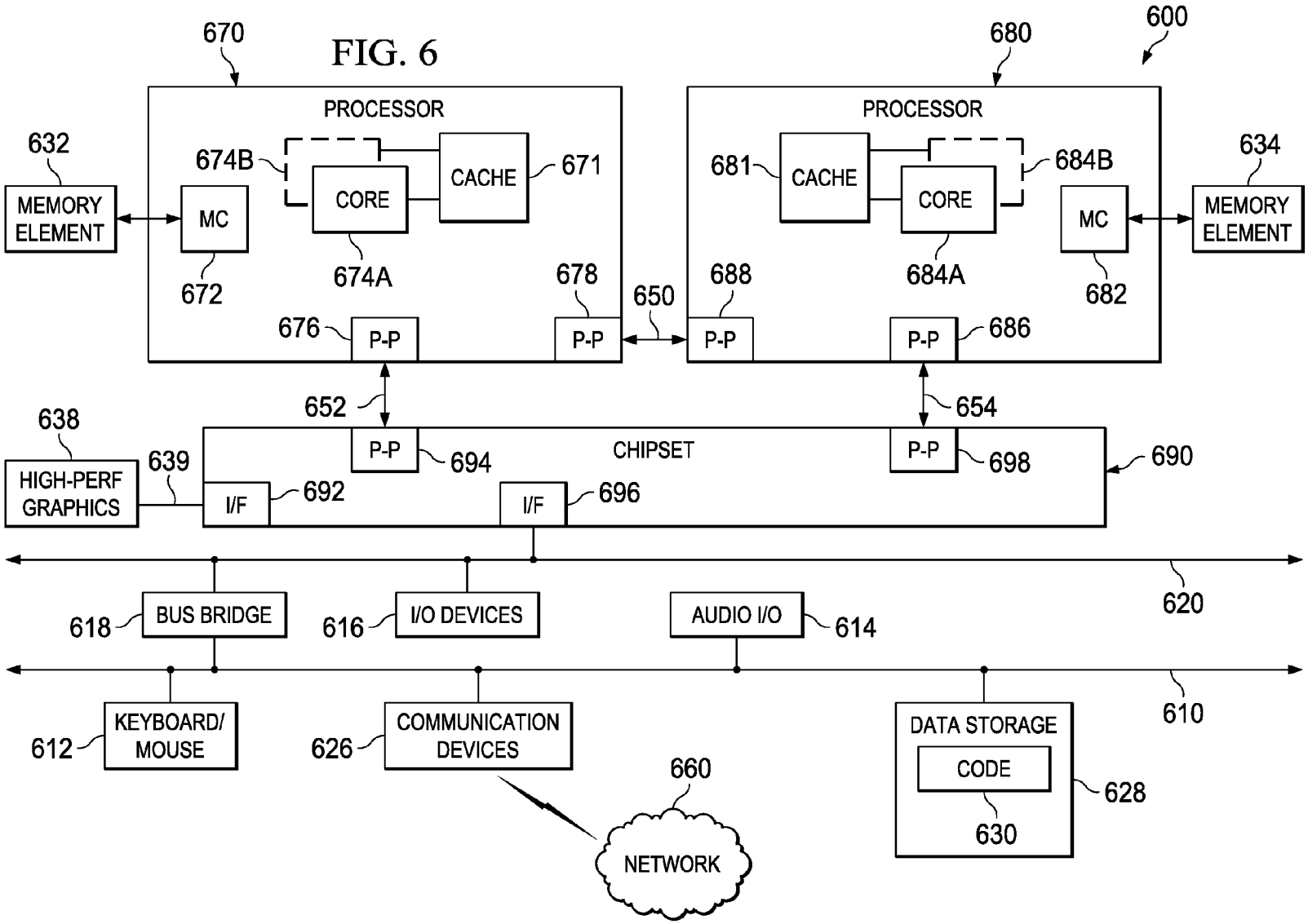
FIG. 6 is a block diagram illustrating an example computing system that is arranged in a point-to-point configuration in accordance with an embodiment.

FIG. 6 illustrates a computing system 600 that is arranged in a point-to-point (PtP) configuration according to an embodiment. In particular, FIG. 6 shows a system where processors, memory, and input/output devices are interconnected by a number of point-to-point interfaces. Generally, one or more of the network elements of electronic device 100*a* may be configured in the same or similar manner as computing system 600.

As illustrated in FIG. 6, system 600 may include several processors, of which only two, processors 670 and 680, are shown for clarity. While two processors 670 and 680 are shown, it is to be understood that an embodiment of system 600 may also include only one such processor. Processors 670 and 680 may each include a set of cores (i.e., processor cores 674A and 674B and processor cores 684A and 684B) to execute multiple threads of a program. The cores may be configured to execute instruction code in a manner similar to that discussed above with reference to FIGS. 2-6. Each processor 670, 680 may include at least one shared cache 671, 681. Shared caches 671, 681 may store data (e.g., instructions) that are utilized by one or more components of processors 670, 680, such as processor cores 674 and 684.

Processors 670 and 680 may also each include integrated memory controller logic (MC) 672 and 682 to communicate with memory elements 632 and 634. Memory elements 632 and/or 634 may store various data used by processors 670 and 680. In alternative embodiments, memory controller logic 672 and 682 may be discrete logic separate from processors 670 and 680.

Processors 670 and 680 may be any type of processor, and may exchange data via a point-to-point (PtP) interface 650 using point-to-point interface circuits 678 and 686, respectively. Processors 670 and 680 may each exchange data with a control logic 690 via individual point-to-point interfaces 652 and 654 using point-to-point interface circuits 676, 686, 694, and 696. Control logic 690 may also exchange data with a high-performance graphics circuit 638 via a high-performance graphics interface 639, using an interface circuit 692, which could be a PtP interface circuit. In alternative embodiments, any or all of the PtP links illustrated in FIG. 6 could be implemented as a multi-drop bus rather than a PtP link.

Control logic 690 may be in communication with a bus 620 via an interface circuit 696. Bus 620 may have one or more devices that communicate over it, such as a bus bridge 618 and I/O devices 616. Via a bus 610, bus bridge 618 may be in communication with other devices such as a keyboard/mouse 612 (or other input devices such as a touch screen, trackball, etc.), communication devices 626 (such as modems, network interface devices, or other types of communication devices that may communicate through a computer network 660), audio I/O devices 614, and/or a data storage device 628. Data storage device 628 may store code 630, which may be executed by processors 670 and/or 680. In alternative embodiments, any portions of the bus architectures could be implemented with one or more PtP links.

The computer system depicted in FIG. 6 is a schematic illustration of an embodiment of a computing system that may be utilized to implement various embodiments discussed herein. It will be appreciated that various components of the system depicted in FIG. 6 may be combined in a system-on-a-chip (SoC) architecture or in any other suitable configuration. For example, embodiments disclosed herein can be incorporated into systems including mobile devices such as smart cellular telephones, tablet computers, personal digital assistants, portable gaming devices, etc. It will be appreciated that these mobile devices may be provided with SoC architectures in at least some embodiments.

Figure 7:
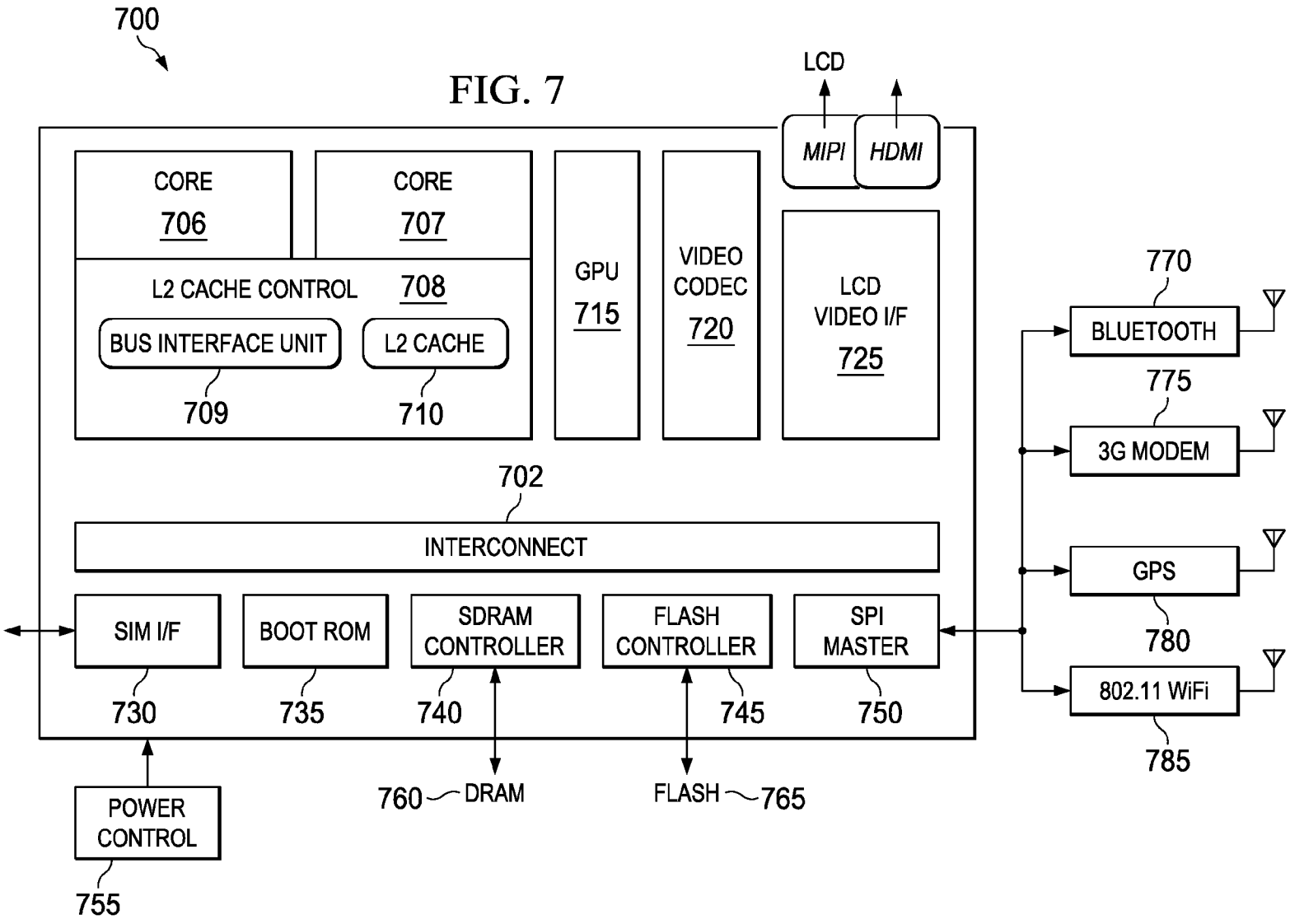
FIG. 7 is a simplified block diagram associated with an example ARM ecosystem system on chip (SOC) of the present disclosure.

Turning to FIG. 7, FIG. 7 is a simplified block diagram associated with an example ARM ecosystem SOC 700 of the present disclosure. At least one example implementation of the present disclosure can include the data rating features discussed herein and an ARM component. For example, the example of FIG. 7 can be associated with any ARM core (e.g., A-9, A-15, etc.). Further, the architecture can be part of any type of tablet, smartphone (inclusive of Android™ phones, iPhones™, iPad™ Google Nexus™, Microsoft Surfacer™, personal computer, server, video processing components, laptop computer (inclusive of any type of notebook), Ultrabook™ system, any type of touch-enabled input device, etc.

In this example of FIG. 7, ARM ecosystem SOC 700 may include multiple cores 706-707, an L2 cache control 708, a bus interface unit 709, an L2 cache 710, a graphics processing unit (GPU) 715, an interconnect 702, a video codec 720, and a liquid crystal display (LCD) I/F 725, which may be associated with mobile industry processor interface (MIPI)/high-definition multimedia interface (HDMI) links that couple to an LCD.

ARM ecosystem SOC 700 may also include a subscriber identity module (SIM) I/F 730, a boot read-only memory (ROM) 735, a synchronous dynamic random access memory (SDRAM) controller 740, a flash controller 745, a serial peripheral interface (SPI) master 750, a suitable power control 755, a dynamic RAM (DRAM) 760, and flash 765. In addition, one or more embodiments include one or more communication capabilities, interfaces, and features such as instances of Bluetooth™ 770, a 3G modem 775, a global positioning system (GPS) 780, and an 802.11 Wi-Fi 785.

In operation, the example of FIG. 7 can offer processing capabilities, along with relatively low power consumption to enable computing of various types (e.g., mobile computing, high-end digital home, servers, wireless infrastructure, etc.). In addition, such an architecture can enable any number of software applications (e.g., Android™, Adobe™ Flash™ Player, Java Platform Standard Edition (Java SE), JavaFX, Linux, Microsoft Windows Embedded, Symbian and Ubuntu, etc.). In at least one embodiment, the core processor may implement an out-of-order superscalar pipeline with a coupled low-latency level-2 cache.

Figure 8:
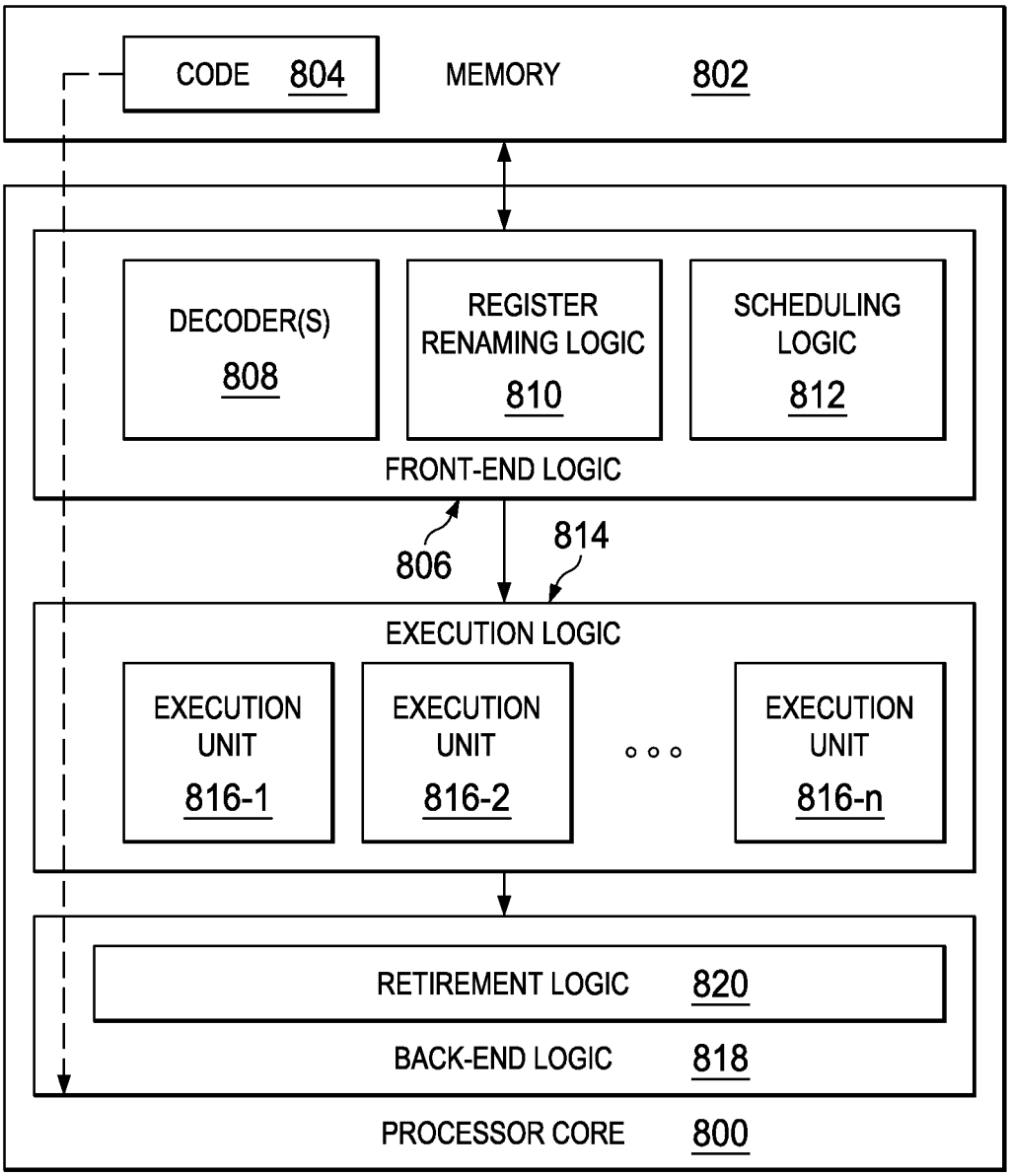
FIG. 8 is a block diagram illustrating an example processor core in accordance with an embodiment.

FIG. 8 illustrates a processor core 800 according to an embodiment. Processor core 8 may be the core for any type of processor, such as a micro-processor, an embedded processor, a digital signal processor (DSP), a network processor, or other device to execute code. Although only one processor core 800 is illustrated in FIG. 8, a processor may alternatively include more than one of the processor core 800 illustrated in FIG. 8. For example, processor core 800 represents an embodiment of processors cores 674*a*, 674*b*, 684*a*, and 684*b* shown and described with reference to processors 670 and 680 of FIG. 6. Processor core 800 may be a single-threaded core or, for at least one embodiment, processor core 800 may be multithreaded in that it may include more than one hardware thread context (or "logical processor") per core.

FIG. 8 also illustrates a memory 802 coupled to processor core 800 in accordance with an embodiment. Memory 802 may be any of a wide variety of memories (including various layers of memory hierarchy) as are known or otherwise available to those of skill in the art. Memory 802 may include code 804, which may be one or more instructions, to be executed by processor core 800. Processor core 800 can follow a program sequence of instructions indicated by code 804. Each instruction enters a front-end logic 806 and is processed by one or more decoders 808. The decoder may generate, as its output, a micro operation such as a fixed width micro operation in a predefined format, or may generate other instructions, microinstructions, or control signals that reflect the original code instruction. Front-end logic 806 also includes register renaming logic 810 and scheduling logic 812, which generally allocate resources and queue the operation corresponding to the instruction for execution.

Processor core 800 can also include execution logic 814 having a set of execution units 816-1 through 816-N. Some embodiments may include a number of execution units dedicated to specific functions or sets of functions. Other embodiments may include only one execution unit or one execution unit that can perform a particular function. Execution logic 814 performs the operations specified by code instructions.

After completion of execution of the operations specified by the code instructions, back-end logic 818 can retire the instructions of code 804. In one embodiment, processor core 800 allows out of order execution but requires in order retirement of instructions. Retirement logic 820 may take a variety of known forms (e.g., re-order buffers or the like). In this manner, processor core 800 is transformed during execution of code 804, at least in terms of the output generated by the decoder, hardware registers and tables utilized by register renaming logic 810, and any registers (not shown) modified by execution logic 814.

Although not illustrated in FIG. 8, a processor may include other elements on a chip with processor core 800, at least some of which were shown and described herein with reference to FIG. 8. For example, as shown in FIG. 8, a processor may include memory control logic along with processor core 800. The processor may include I/O control logic and/or may include I/O control logic integrated with memory control logic.

Note that with the examples provided herein, interaction may be described in terms of two, three, or more network elements. However, this has been done for purposes of clarity and example only. In certain cases, it may be easier to describe one or more of the functionalities of a given set of flows by only referencing a limited number of network elements. It should be appreciated that communication system 80 and its teachings are readily scalable and can accommodate a large number of components, as well as more complicated/sophisticated arrangements and configurations. Accordingly, the examples provided should not limit the scope or inhibit the broad teachings of electronic device 100*a*-100*c* as potentially applied to a myriad of other architectures.

It is also important to note that the operations in the preceding diagrams illustrate only some of the possible correlating scenarios and patterns that may be executed by, or within, communication systems 100*a*-100*c*. Some of these operations may be deleted or removed where appropriate, or these operations may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by electronic device 100*a* in that any suitable arrangements, chronologies, configurations, and timing mechanisms may be provided without departing from the teachings of the present disclosure.

Although the present disclosure has been described in detail with reference to particular arrangements and configurations, these example configurations and arrangements may be changed significantly without departing from the scope of the present disclosure. Moreover, certain components may be combined, separated, eliminated, or added based on particular needs and implementations. Additionally, although electronic device 100*a* has been illustrated with reference to particular elements and operations that facilitate the communication process, these elements and operations may be replaced by any suitable architecture, protocols, and/or processes that achieve the intended functionality of electronic device 100*a*. As used herein, the term "and/or" is to include an and or an or condition. For example, A, B, and/or C would include A, B, and C; A and B; A and C; B and C; A, B, or C; A or B; A or C; B or C; and any other variations thereof.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

OTHER NOTES AND EXAMPLES

Example A1 is an apparatus that includes a plurality of audio acquisition areas, where each of the plurality of audio acquisition areas includes a microphone element to detect audio data, an audio opening that allows the audio data to travel to the microphone element, and a windscreen that covers at least the audio opening. The apparatus also includes an audio module configured to receive the audio data from each of the plurality of audio acquisition areas.

In Example A2, the subject matter of Example A1 may optionally include where the audio module is configured to filter the audio data received from each of the plurality of audio acquisition areas and determine an audio data with a least amount of wind noise.

In Example A3, the subject matter of any of the preceding 'A' Examples can optionally include where the audio module is configured to combine the audio data from each of the plurality of audio acquisition areas and a weighting factor is assigned to the audio data from each of the plurality of audio acquisition areas.

In Example A4, the subject matter of any of the preceding 'A' Examples can optionally include where the windscreen can diffuse pressure fluctuations created by wind by breaking up big lumps of the wind into smaller bits before the wind reaches the audio opening.

In Example A5, the subject matter of any of the preceding 'A' Examples can optionally include where the apparatus is a wearable electronic device.

In Example A6, the subject matter of any of the preceding 'A' Examples can optionally include where the audio data is voice data.

Example C1 is at least one machine readable storage medium having one or more instructions that when executed by at least one processor cause the at least one processor to receive audio data from a plurality of audio acquisition areas, where each of the plurality of audio acquisition areas includes a microphone element to detect audio data, an audio opening that allows the audio data to travel to the microphone element, and a windscreen that covers at least the audio opening.

In Example C2, the subject matter of Example C1 can optionally include one or more instructions that when executed by the at least one processor cause the at least one processor to filter the audio data received from each of the plurality of audio acquisition areas and determine an audio data with a least amount of wind noise.

In Example C3, the subject matter of any one of Examples C1-C2 can optionally include one or more instructions that when executed by the at least one processor cause the at least one processor to combine the audio data from each of the plurality of audio acquisition areas and a weighting factor is assigned to the audio data from each of the plurality of audio acquisition areas.

In Example C4, the subject matter of any one of Examples C1-C3 can optionally include where the windscreen can diffuse pressure fluctuations created by wind by breaking up big lumps of the wind into smaller bits before the wind reaches the audio opening.

In Example C5, the subject matter of any one of Examples C1-C4 can optionally include where the apparatus is a wearable electronic device.

In Example C6, the subject matter of any one of Example C1-C5 can optionally include one or more instructions that when executed by the at least one processor cause the at least one processor to communicate the logged plurality of requests to a network element.

In Example C7, the subject matter of any one of Examples C1-C6 can optionally include one or more instructions that when executed by the at least one processor cause the at least one processor to receive a reputation rating for the application from a network element, wherein the reputation rating was created from logged sensor request information for the application, wherein the logged sensor request information was received from a plurality of devices.

Example M1 is a method that includes receiving audio data from each of the plurality of audio acquisition areas, where each of the plurality of audio acquisition areas includes a microphone element to detect audio data, an audio opening that allows the audio data to travel to the microphone element, and a windscreen that covers at least the audio opening. The method can also include processing the audio data.

In Example M2, the subject matter of any of the preceding 'M' Examples can optionally include filtering the audio data received from each of the plurality of audio acquisition areas and determine an audio data with a least amount of wind noise.

In Example M3, the subject matter of any of the preceding 'M' Examples can optionally include combining the audio data from each of the plurality of audio acquisition areas and a weighting factor is assigned to the audio data from each of the plurality of audio acquisition areas.

In Example M4, the subject matter of any of the preceding 'M' Examples can optionally include where the windscreen can diffuse pressure fluctuations created by wind by breaking up big lumps of the wind into smaller bits before the wind reaches the audio opening.

In Example M5, the subject matter of any of the preceding 'M' Examples can optionally include where the apparatus is a wearable electronic device.

Example S1 is a system that includes an audio module configured for receiving audio data from each of the plurality of audio acquisition areas, where each of the plurality of audio acquisition areas includes a microphone element to detect audio data, an audio opening that allows the audio data to travel to the microphone element, and a windscreen that covers at least the audio opening. The system can also include processing the audio data.

In Example S2, the subject matter of 'S1' can may optionally include where he audio module is further configured to filter the audio data received from each of the plurality of audio acquisition areas and determine an audio data with a least amount of wind noise.

In Example S3, the subject matter of any of the preceding 'SS' Examples can optionally include where the audio module is further configured to combine the audio data from each of the plurality of audio acquisition areas and a weighting factor is assigned to the audio data from each of the plurality of audio acquisition areas.

In Example S4, the subject matter of any of the preceding 'SS' Examples can optionally include where the audio data is voice data.

Example X1 is a machine-readable storage medium including machine-readable instructions to implement a method or realize an apparatus as in any one of the Examples A1-A6 and M1-M5. Example Y1 is an apparatus comprising means for performing of any of the Example methods M1-M5. In Example Y2, the subject matter of Example Y1 can optionally include the means for performing the method comprising a processor and a memory. In Example Y3, the subject matter of Example Y2 can optionally include the memory comprising machine-readable instructions.

What is claimed is:

1. A wearable apparatus comprising:

a plurality of audio acquisition areas included in the apparatus, wherein the plurality of audio acquisition areas are at different orientations to capture sound from a different direction and each of the plurality of audio acquisition areas includes:

a directional microphone element located on a front area of the apparatus to detect audio data;

an audio opening that allows the audio data to travel to the microphone element; and a windscreen that covers at least the audio opening wherein the windscreen can diffuse pressure fluctuations created by wind; and an audio module configured to receive the audio data from each of the plurality of audio acquisition areas, wherein the audio module is configured to filter the audio data received from each of the plurality of audio acquisition areas and determine an audio data from a specific audio acquisition area that includes a least amount of wind noise.

2. The apparatus of claim 1, wherein the audio module is configured to assign a weighting factor to the audio data from each of the plurality of audio acquisition areas.

3. The apparatus of claim 1, wherein the apparatus is eyewear.

4. The apparatus of claim 1, wherein the audio data is voice data.

5. The apparatus of claim 1, wherein the audio module is configured to combine the audio data from each of the plurality of audio acquisition areas to create a composite audio data.

6. At least one non-transitory machine readable storage medium comprising one or more instructions that when executed by at least one processor, cause the processor to:

receive audio data from a plurality of audio acquisition areas included in a wearable apparatus, wherein the plurality of audio acquisition areas are at different orientations to capture sound from a different direction and each of the plurality of audio acquisition areas includes:

a directional microphone element located on a front area of the apparatus to detect audio data;

an audio opening that allows the audio data to travel to the microphone element; and a windscreen that covers at least the audio opening, wherein the windscreen can diffuse pressure fluctuations created by wind;

filter the audio data received from each of the plurality of audio acquisition areas; and determine an audio data from a specific audio acquisition area that includes a least amount of wind noise.

7. The at least one machine readable storage medium of claim 6, comprising one or more instructions that when executed by the at least one processor, cause the processor to:

assign a weighting factor to the audio data from each of the plurality of audio acquisition areas.

8. The at least one machine readable storage medium of claim 6, wherein the apparatus is eyewear.

9. The at least one machine readable storage medium of claim 6, comprising one or more instructions that when executed by the at least one processor, cause the processor to:

combine the audio data from each of the plurality of audio acquisition areas to create a composite audio data.

10. A method comprising:

receiving audio data from a plurality of audio acquisition areas included in a wearable apparatus, wherein the plurality of audio acquisition areas are at different orientations to capture sound from a different direction and each of the plurality of audio acquisition areas includes:

a directional microphone element located on a front area of the apparatus to detect audio data;

an audio opening that allows the audio data to travel to the microphone element; and a windscreen that covers at least the audio opening, wherein the windscreen can diffuse pressure fluctuations created by wind;

filtering the audio data received from each of the plurality of audio acquisition areas; and determining an audio data from a specific audio acquisition area that includes a least amount of wind noise.

11. The method of claim 10, further comprising:

assigning a weighting factor to the audio data from each of the plurality of audio acquisition areas.

12. The method of claim 10, wherein the apparatus is eyewear.

13. The method of claim 10, further comprising:

combining the audio data from each of the plurality of audio acquisition areas to create a composite audio data.

14. A wearable system comprising:

an audio module configured for:

receiving audio data from a plurality of audio acquisition areas included in the system, wherein the plurality of audio acquisition areas are at different orientations to capture sound from a different direction and each of the plurality of audio acquisition areas includes:

a directional microphone element located on a front area of the system to detect audio data;

an audio opening that allows the audio data to travel to the microphone element; and a windscreen that covers at least the audio opening wherein the windscreen can diffuse pressure fluctuations created by wind; and filtering the audio data received from each of the plurality of audio acquisition areas; and determining an audio data from a specific audio acquisition area that includes a least amount of wind noise.

15. The system of claim 14, wherein the audio module is further configured to assign a weighting factor to the audio data from each of the plurality of audio acquisition areas.

16. The system of claim 14, wherein the audio data is voice data.

17. The system of claim 14, wherein the audio module is further configured to combine the audio data from each of the plurality of audio acquisition areas to create a composite audio data.

* * * * *